United States Patent [19]

Gustavsson et al.

[11] 4,092,901

[45] June 6, 1978

[54] DEVICE FOR FIREARM INTENDED FOR TANK WHICH HAS A BARREL SUPPORTED IN A RECOIL JACKET

[75] Inventors: Lars G. T. Gustavsson; Sven-Håkan Svensson, both of Karlskoga, Sweden

[73] Assignee: AB Bofors, Bofors, Sweden

[21] Appl. No.: 722,185

[22] Filed: Sep. 10, 1976

[30] Foreign Application Priority Data

Sep. 12, 1975 Sweden ..... 7510205

[51] Int. Cl.[2] ..... F41F 9/04

[52] U.S. Cl. ..... 89/46; 89/33 F; 89/36 L

[58] Field of Search ..... 89/33 A, 33 B, 33 F, 89/36 H, 36 K, 36 L, 40 B, 45, 46, 47

[56] References Cited

FOREIGN PATENT DOCUMENTS 2,149,954 4/1973 Germany ..... 89/40 B

*Primary Examiner*—Stephen C. Bentley

*Attorney, Agent, or Firm*—Pollock, Vande Sande & Priddy

[57] ABSTRACT

A firearm of the type which loads from the bottom of the recoil jacket includes protective doors opened by the loading mechanism as it rises into ramming position. One pair of doors is mounted in the recoil jacket and another is mounted on the barrel at a different height from the first, so that the doors slide along one another when the firearm recoils.

10 Claims, 8 Drawing Figures

DEVICE FOR FIREARM INTENDED FOR TANK WHICH HAS A BARREL SUPPORTED IN A RECOIL JACKET

BACKGROUND OF THE INVENTION

The present invention relates to a device for a firearm which has a barrel supported in a recoil jacket and which is comprised in a tank provided with loading members for the firearm arranged to convey rounds to the firearm from a magazine which is separate from the firearm via the under side of the recoil jacket.

The primary purpose of the invention is, for a weapon arranged on a tank, to provide protection for vital parts of the firearm during the major portion of the time the tank is in use. Through the invention, it will be possible to achieve a very high protective effect at the firearm, which need be neglected only during a very short period of time at the moment when the actual ramming takes place.

BRIEF DESCRIPTION OF THE DRAWINGS

An embodiment proposed at present of a device which has the characteristics significant for the invention will be described in the following, with reference to the accompanying drawings, in which

FIGS. 1 and 2 are intended to illustrate a tank provided with a small turret 1, a so-called miniturret, which is rotatably arranged in a frame 3 arranged in a tank chassis 2 via a ball bearing 4 applied on the outside of the part 1*a* of the turret which extends downwards as shown in FIG. 3*a*. The miniturret has been given little extent vertically, and is made with upper parts which are to a slight extent above the other parts of the top of the tank, so that it essentially adapts itself to the latter, and with parts which likewise have a limited extent downwards. Under the turret, inside the tank, a seat is arranged as well as a foot plate for a crew member. The seat and plate are connected to the turret via a fastening member from below so that they follow its movements in traverse in relation to the tank. On the top of the turret a cradle carrier is fastened comprising side parts 5 for trunnions 7 for a large-calibre (e.g. 105 mm) firearm 6. The extent vertically of the side parts corresponds essentially to one-half the height of the turret which, together with their position on the turret in question produces the result that the firearm will have a marked high position on the tank. The firearm thereby is capable of moving to comparatively large angles of depression and elevation. The elevation and depression of the weapon are performed by means of an elevation rod which extends down into the tank where it can be actuated with a motor via a gear device. The side parts are provided with recesses in order to provide for the application of side viewing apertures on the turret. Furthermore, farthest to the rear, the tank is provided with a so-called externally suspended magazine 8 for ammunition carried in the tank in the form of a number of rounds which can be fed out via one or two feed-out positions on the magazine, depending on the internal embodiment and disposition of this. The magazine is rotatably suspended in the tank so that when driving on uneven ground it can be swung out of the way, upwards. In its normal position when firing with the tank, the upper side of the magazine is essentially in the same plane as the upper side of the tank at the rear parts, which involves that the magazine at the transfer of rounds is placed comparatively far below the ramming position at the rear parts of the firearm. The front plane of the magazine is moreover somewhat to the rear of the rear plane of the rear parts of the firearm.

Figure 1:
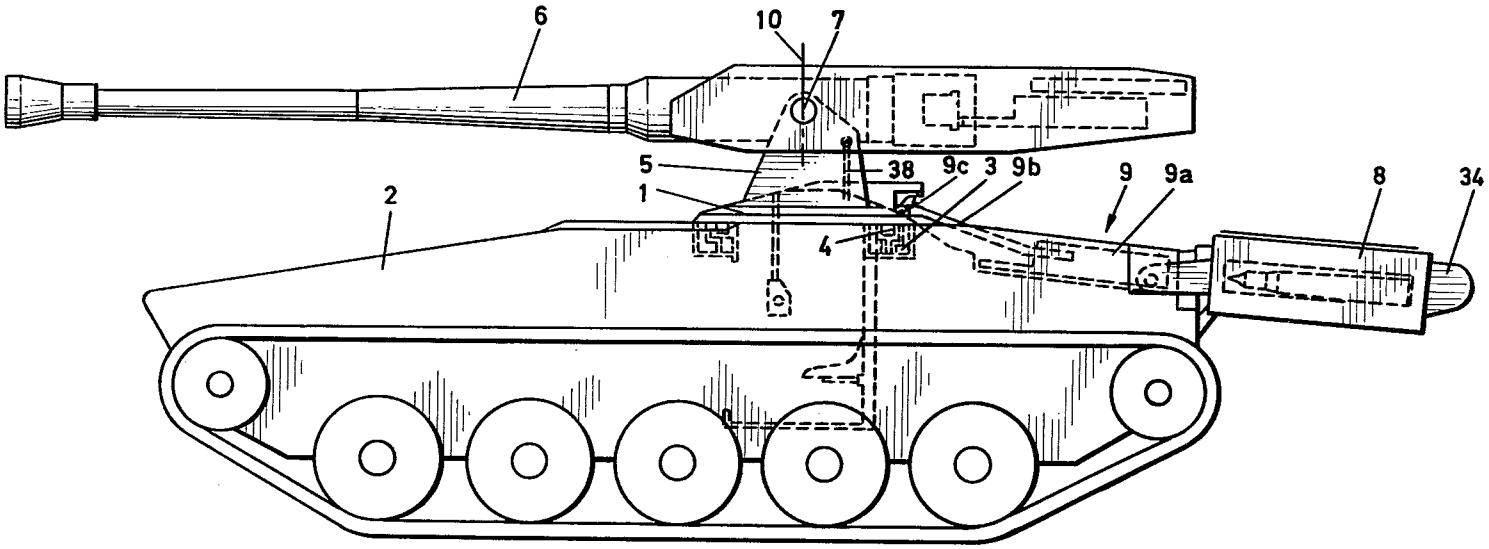
FIG. 1 shows a side view, partly in cross-section, of a tank utilizing the device.
Figure 2:
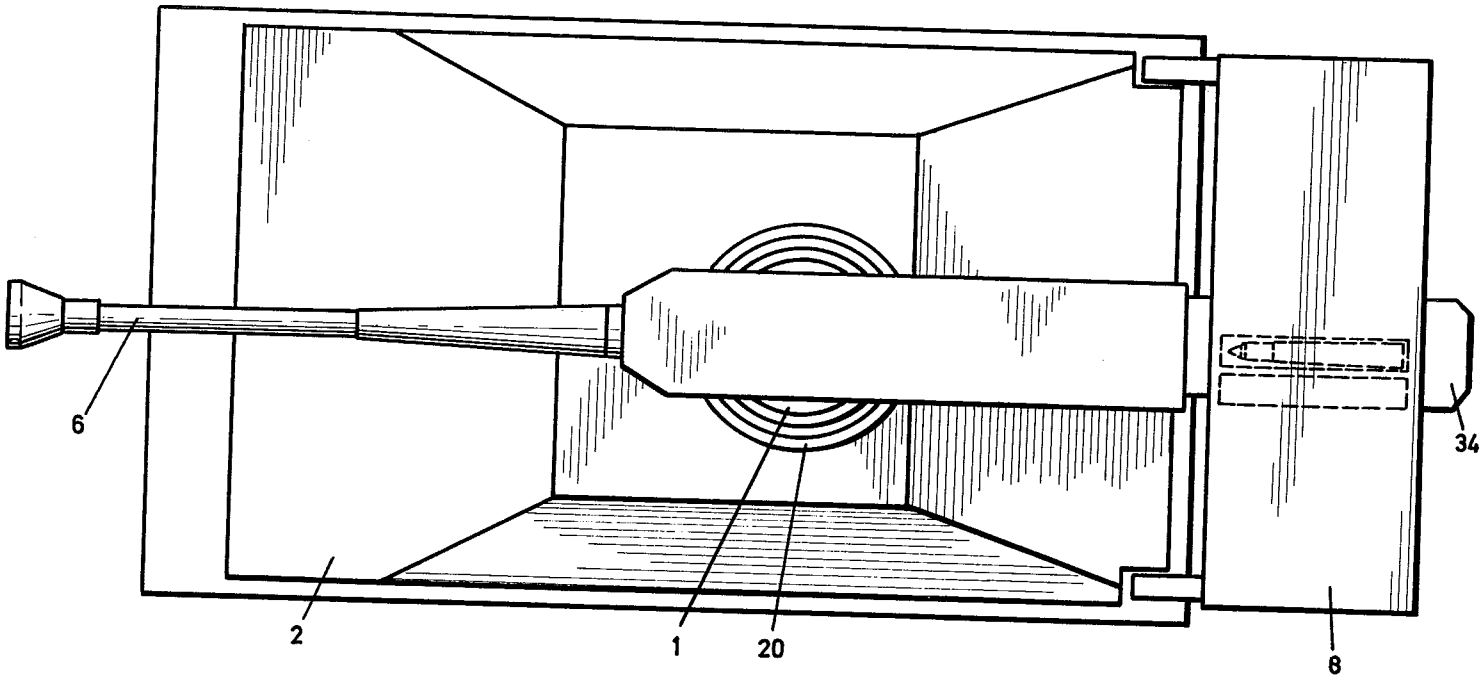
FIG. 2 shows a top view of the tank according to FIG. 1.

In the space located in front of the magazine and between the lower parts of the firearm and the upper parts of the top of the tank (in FIG. 1) a loading pendulum 9 is arranged, comprising sections 9*a* and an arm 9*b* which can coact with a round which supports a fork-shaped front part. The pendulum is rotatably arranged around a turning centre 9*c* which it has at one end of the arm, which turning centre is located below and at the side of the trunnions 7 of the firearm and the original position of the loading pendulum. By means of its turning centre, the loading pendulum is also rotatably arranged in relation to the tank chassis and the firearm (the turret) around a traversing axis which coincides with the traversing axis 10 of the firearm. In this way, the loading pendulum, independent of the elevation and vertical position of the firearm can be set in a magazine position (see FIG. 1) where rounds can be fed into the pendulum, after which the pendulum can be swung in the traversing direction to the position in traverse which the firearm has, where the actual movement of the pendulum, i.e., the ramming movement, takes place.

FIGS. 3*a*–3*c* and 4 are intended to show the function and design of the loading pendulum and turret in more detail. The sections 9*a* of the loading pendulum which can coact with the round consist of an armour tube which has a longitudinal upper through slot 9*d* which provides for coaction with the rammer unit in the ramming position. At its front part, the loading pendulum is made with an extended bottom part 9*e* which is directed towards the turning centre 9*c* for the pendulum. The pendulum supports the round with the front parts of the round resting against said extended bottom part. The arm 9*b* is supported in one end on a journal which extends at right angles to the arm and which is supported in bearing brackets 11. In its other end, the arm is fastened via its fork-shaped section, the prongs of which extend on either side of the armour tube to the central parts of the armour tube, and this fastening is also made rotatable by means of fastening journals which extend out from the armour tube. At the fastening journals, helical springs 12, 13 are arranged on either side of the tube, which helical springs are arranged to keep the armour tube essentially parallel to the barrel even after it has been turned up from the magazine position. This fixing of the position by means of the helical springs is intended to prevent such an oblique position of the armour tube at the turning movement in the traversing plane that the rear or front parts of the armour tube would hit the top of the tank and/or the under side of the barrel. On either side of the armour tube, the helical springs are fastened to the armour tube and the prongs 9b of the arm in such a way that one spring strives to turn the tube clockwise and the other spring strives to turn the tube counter-clockwise. The rotatable fastening of the arm is necessary due to the fact that the pendulum and the firearm have different elevation bearings, and that the armour tube must be capable of adapting itself to the different elevation positions of the barrel.

The bearing brackets 11 of the pendulum are fastened to a ring 14 which via ball bearings 15 is rotatably fastened in relation to the turret 1, and particularly via a further ball bearing in relation to the fixed frame 3 of the tank chassis. The frame 3 has a box-shaped cross-section with a special design which permits the application of ring, turret, ball bearing and frame favourably from the point of view of protection and functioning in relation to each other. The turret is made with an overlapping flange at the ring which in the corresponding way is provided with an overlapping flange at the frame so that contaminations are prevented from entering between the parts in question. The turret, ring and frame moreover have positions at such levels in relation to each other that e.g. water will have a certain path to run off along the different parts.

The swinging movements of the loading pendulum are thus achieved by means of the turning of the ring around its centre line which coincides with the axis 10. The ring 14 is made with an outer gear arc 14a, not shown in detail, via which the ring can be driven by means of a hydraulic or an electric motor, the shaft part of which is designated 16, while the driving teeth of the shaft are designated 17. The shaft part 16 and the gear 17 are arranged at recesses in the box-shaped frame 3. The turret 1 also has an external gear arc 1b at its part 1a which extends down into the tank.

The armour tube 9a, in the magazine position of the loading pendulum, i.e., the position according to FIG. 1, is intended to be extending down into a special shaft 18 made in the tank chassis together with a part of the arm 9b. The shaft is made with sealing covers which can be opened and closed, which when the pendulum is raised from the magazine position open upwards and when the pendulum goes down into the shaft can be closed again, so that effective sealing against contaminations is obtained.

When the loading pendulum swings around the axis 10, it is supported on a fixed and essentially circular slide track 20. In order to permit the armour tube to go down into the shaft, however, the arm 9b will need to cross the slide track. The slide track is therefore made with a small part 20a which can be lowered to a level below the other part of the slide track. Said part 20a is located in front of and above the front parts of the shaft. The raising and lowering of the slide track 20a between the positions where the armour tube is lowered into the shaft and where the armour tube is swung up from the shaft is carried out by means of a control device 21 in the form of a lifting cylinder or the like. The loading pendulum coacts with the slide track via a wheel 22 or a corresponding part which is arranged in the arm with its supporting axis coinciding with or parallel to the longitudinal direction of the arm. When the pendulum is swung along the slide track 20, it is assumed to clear the upper parts of the tank and the lower parts of the firearm. In the case shown, a straight slide track has been foreseen. However, it is, of course, conceivable to give the slide track different height levels along different parts of its extent so that the pendulum can be considered to swing in a wavy lateral plane. The wheel is located on the arm at the inner half of this, e.g. at a distance from the turning centre 9c which is essentially equal to one third of the length of the arm.

In the raised position, where the loading pendulum can coact with the entire slide track, in accordance with the design shown, the loading pendulum is adjustable via the gear 17 to a traversing position which coincides with the traversing position which the firearm has. In said coinciding traverse positions, the pendulum can be swung up from the position coacting with the slide track to the ramming position at the firearm. This swinging up in the point 9c is carried out by means of a pulling part 23 supported in the turret in the form of a hook fastened in one end of a straight gear rack 24. In said coinciding traverse position, the hook can coact with a member 25 fixed to the pendulum arm which in the coinciding traverse positions will be exactly opposite the hook 23. The movement of the gear rack is achieved with a motor via its driving shaft 26.

In the case shown, the recoil jacket 27 of the firearm is provided with lower covers 28, and covers 29 are fastened to the breech ring. See FIG. 3c. Said covers 28 and 29 are intended to seal against foreign objects when firing is not taking place, and at the same time with their insides to constitute surfaces for empty cartridge cases when these are ejected, which takes place via a cover 30 arranged at the rear section of the recoil jacket which is pushed up by the cartridge cases from the inside and falls down of its own weight. As will be noted from FIG. 3a, the covers 28 and 29 can be swung up by means of the loading pendulum when this enters from below in relation to the recoil jacket and the breech ring. The covers 28 and 29 are arranged at different levels, so that they cannot be pushed over each other at the recoil.

Because of the different supporting points for the elevation movements for the firearm and the pendulum, a space which exceeds the length of the armour tube will be necessary at the ramming position inside the recoil jacket. The ramming movement will also be comparatively long, and therefore, in the present case, so-called two-stage ramming has been chosen, and in the first stage a first ramming arm 31 first moves the round a predetermined distance and thereafter a second ramming arm 32 moves the round the rest of the way so that the round will be inserted in the chamber. The two-stage rammer used is made in such a way that it permits smooth ramming. By ramming position is meant the position the round has before the ramming arms 31, 32 enter into coaction with the round. The recoil buffers have the designation 33.

The magazine 8 is also made with a rammer 34 which, as in the case described above, shows a two-stage rammer that can be made in a way which is known in itself. The rammer 34 moves the round out of the magazine and into the armour tube.

The magazine can be made with one or two feed-out positions for rounds. When there is one feed-out position, the position of the armour tube in the shaft will be one and the same. In the case of two feed-out positions arranged close to each other, the shaft is made comparatively wider, so that the armour tube can perform a small lateral movement in the shaft between two different angular positions, where the loading pendulum in one of the angular positions is opposite one of the feed-out positions and in the other angular position is opposite the other feed-out position.

The magazine can be made in two different part units which have different kinds of ammunition. On the basis of the design of the magazine and the disposition within the magazine, one or two feed-out positions may be chosen.

Briefly, the equipment described above functions in the following way. The loading pendulum is set in the magazine position according to FIG. 3*a* so that a round can be fed into it or has been fed into the armour tube from the magazine by means of the rammer 34. Thereafter the pendulum is turned up out of the shaft in connection with the covers being opened, particularly by means of the armour tube. It is also possible to have the covers open while firing is being carried out. The turning up takes place by means of the hydraulic cylinder 21. Thereafter the ring 14 is turned via the gear 17 so that the loading pendulum assumes the traverse position of the firearm. Thereafter the pendulum is turned up further by means of the gear rack 26 to the position shown in FIG. 3*a* where the round is moved out of the loading pendulum by the rammer, and in the reverse order in relation to the one described above can it return to the magazine to fetch a new round.

In accordance with what is stated above, the driving can take place by means of hydraulic or electric motors, and in the case of the electric motors can these be driven by the spare batteries in the tank, so that they will not be dependent on whether or not the engine of the tank is running. When a gun which has been deflected more than 45° from the direction in which the tank is being driven is loaded, the loading pendulum will swing outside the tank, but not more than approx. 0.5 m outside the side of the tank.

The loading procedure described will be fully automatic, and can be carried out very rapidly. For guidance of the loading pendulum in the traverse direction, mechanical blocking devices should appropriately be used which are activated when the angles of traverse of the pendulum and the firearm coincide, but which are deactivated when the pendulum is to return to fetch a new round. The guidance is also carried out in such a way that the pendulum takes the shortest way in traverse, which involves that the blocking devices must be made so that they can function for both directions of swinging. Examples of such blocking devices are designated 35*a* and 35*b*. The blocking devices can be made in many alternative ways, and in the turret they consist of plungers which can be activated which coact with holes in the ring 14. In the case shown, both the turret and the tank chassis are provided with movable plungers (35*a* and 35*b*) which coact with holes in the ring. The plungers are controlled by electromagnets or hydraulic cylinders in order to achieve the deactivation function. The deactivation can, for instance, also be carried out by means of the member 25 which in the ramming position is entirely retracted by the hook 24, and the member in the entirely retracted position is arranged to actuate the plungers for deactivation. It is also conceivable to use a gripping fork which in the traversing position in question engages the member 25 and which is moved aside by the member in its entirely retracted position. The traversing of the turret and the firearm is achieved by means of a driving motor 36. When swinging in to the ramming position, the rear/upper parts of the armour tube will first hit the top at the recoil jacket, and will then finally be adapted to the present angle of elevation of the firearm. In the corresponding way, the rear/-lower section of the armour tube will hit the bottom of the shaft, after which it will adapt itself to the latter.

Said gear rack 24 is guided in a recess in the turret which is made with a protruding overhead guard 37 which protects the hook and the gear rack from above against foreign objects. A unit with a seat and foot plate for a crew member is also connected to the turret, which follows the movements of the turret in traverse. Elevation of the firearm takes place by means of the rod 38 (FIG. 1) which extends into the tank in a way which is known in itself.

Figure 3A:
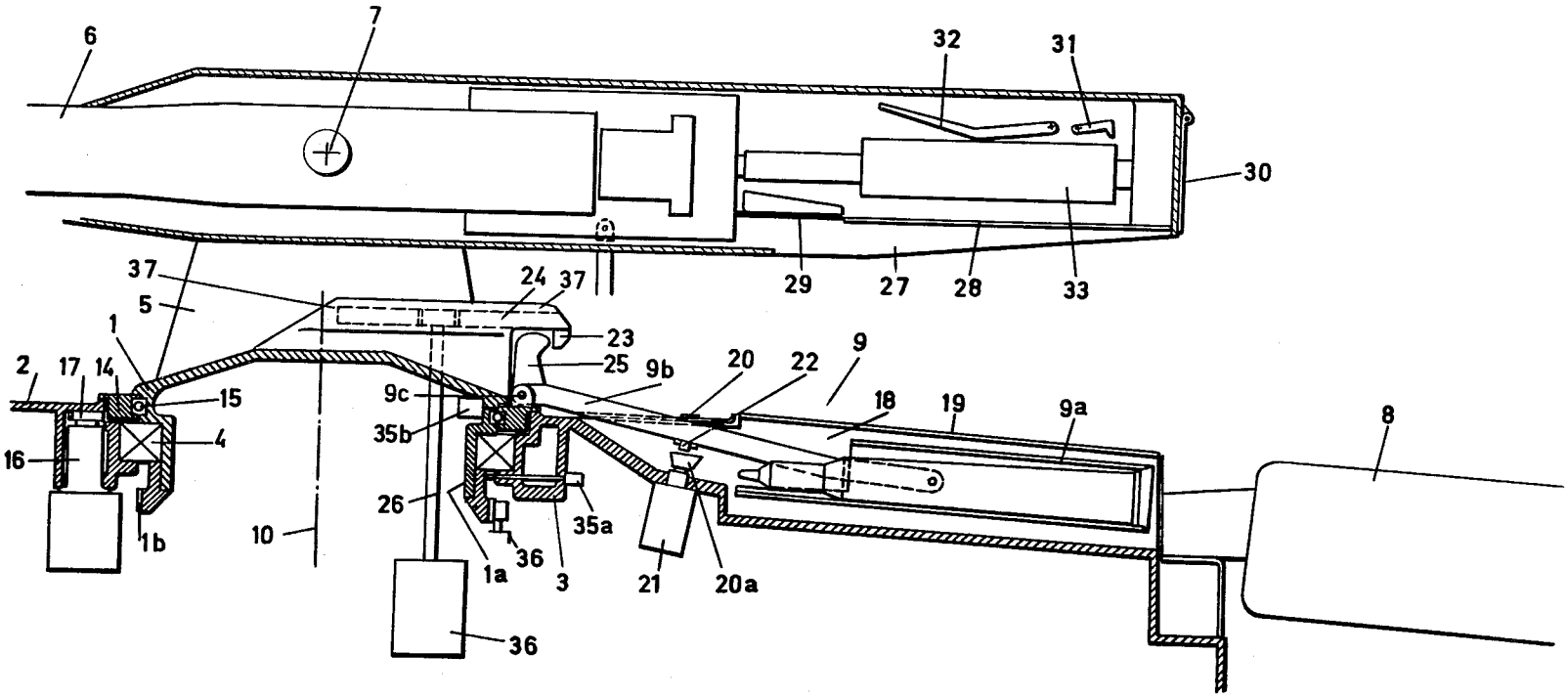
FIG. 3*a* shows a side view, partly in section, of the loading mechanism.
Figure 3B:
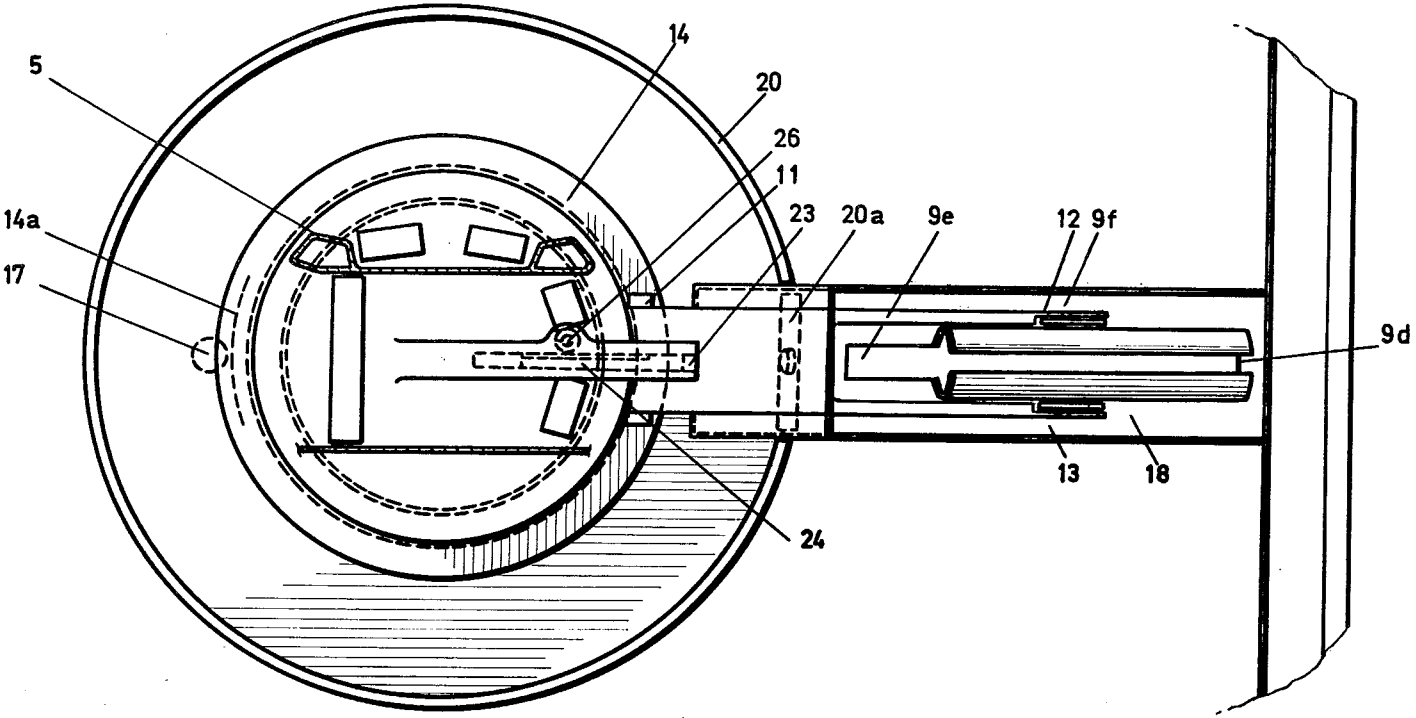
FIG. 3*b* shows a plan view of the loading pendulum, its traversing track and associated equipment.
Figure 3C:
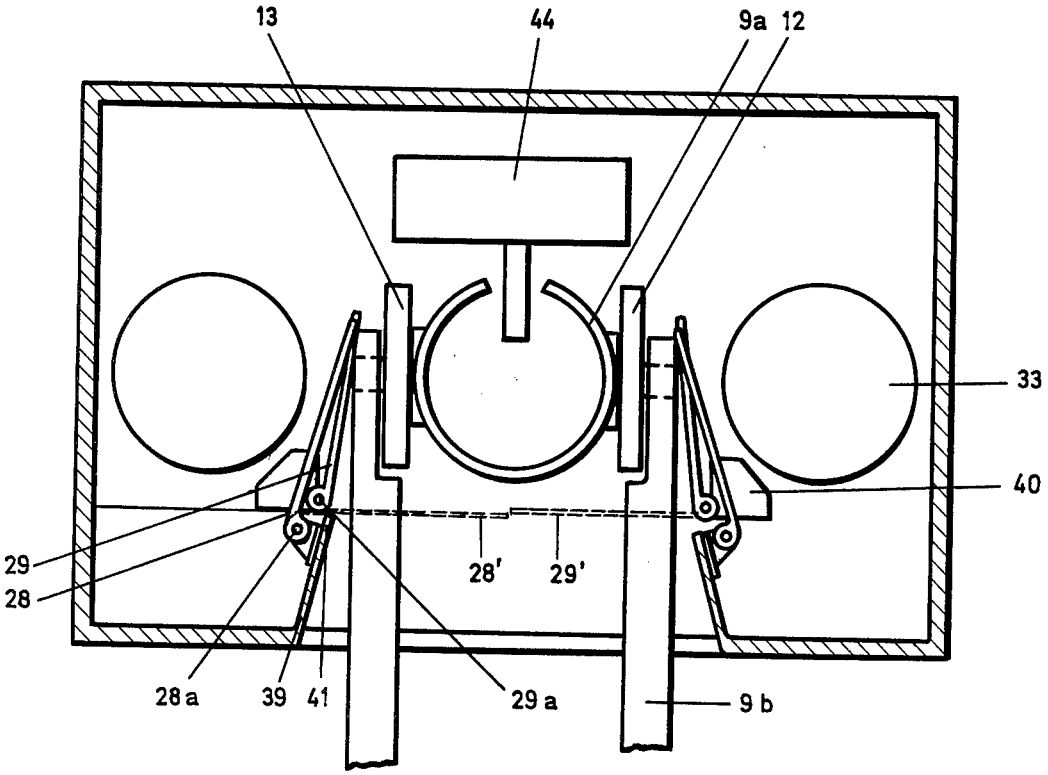
FIG. 3*c* shows a view of the loading pendulum in ramming position in the recoil jacket.
Figure 4:
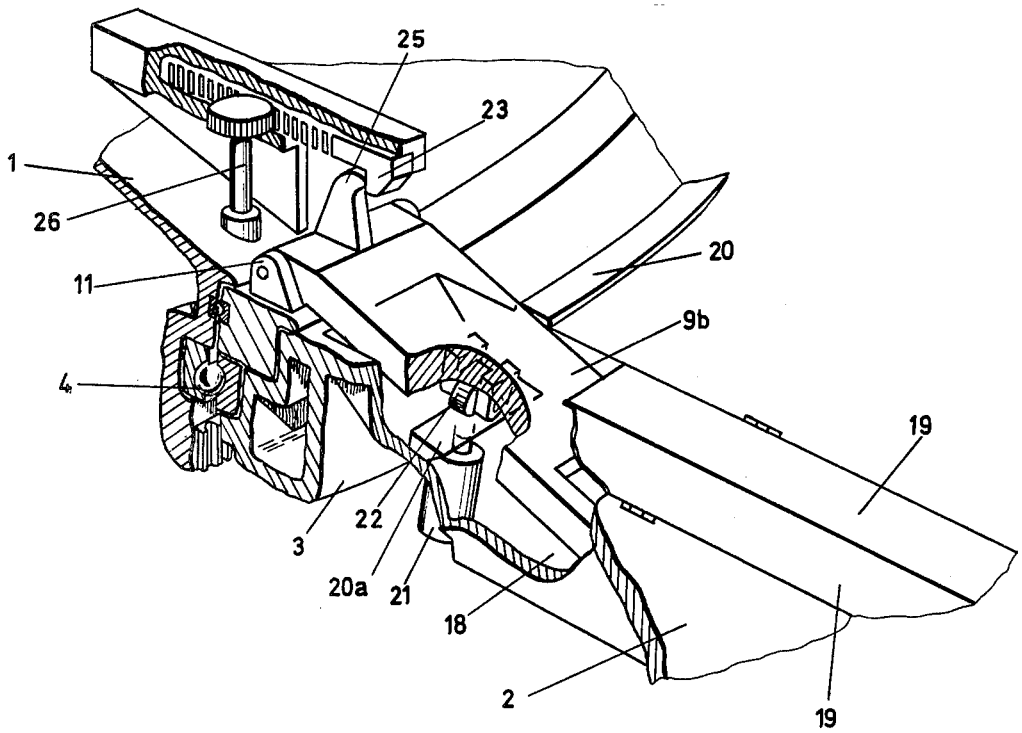
FIG. 4 shows a perspective view, partly in section, of the leading pendulum support and actuating mechanism.
Figure 5:
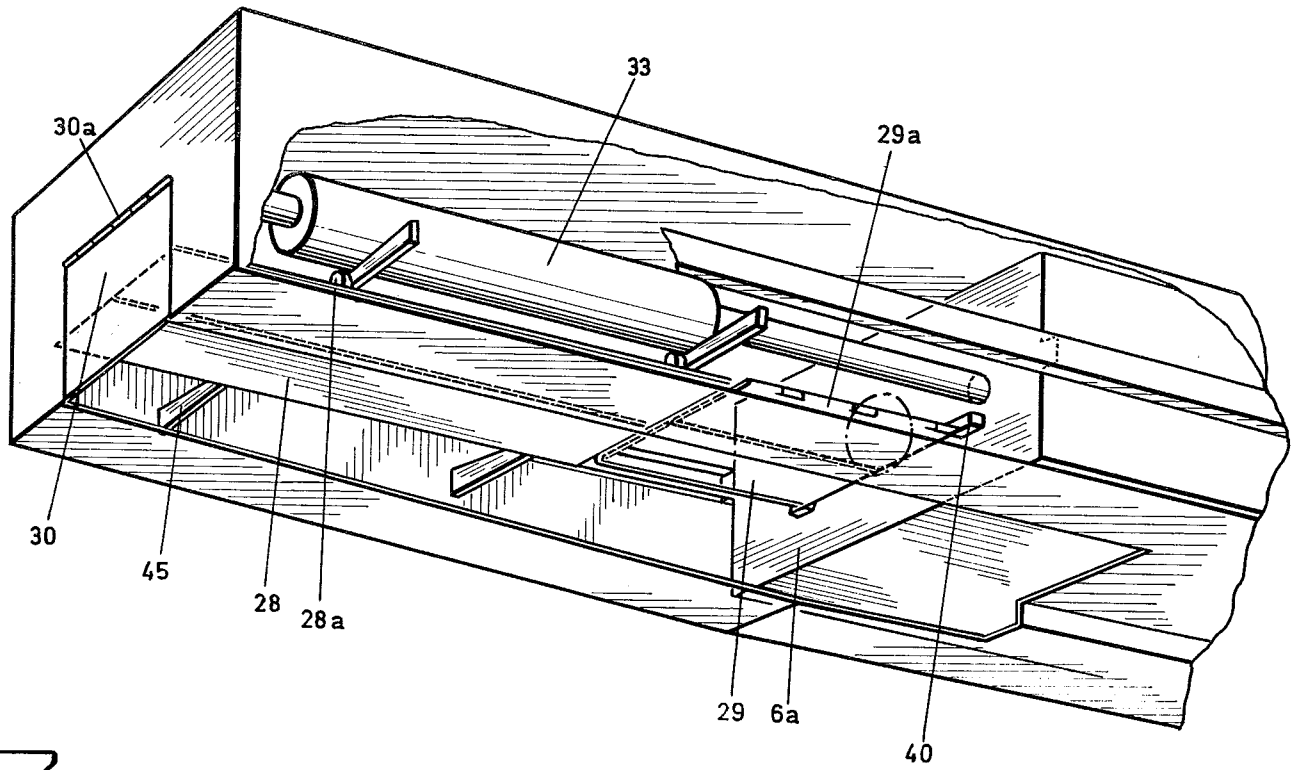
FIG. 5 shows a perspective view from below the sealing covers arranged at the recoil jacket and the barrel.

The covers according to the present invention are particularly shown in FIG. 3*c* and FIG. 5, which show two different embodiments of the design of the firearm and the way in which the covers are fastened.

In principle, the covers consist of two first covers 28 comprised in a first pair of covers which are supported on the recoil jacket and two second covers comprised in a second pair of covers 29 which are supported on the breech ring of the firearm. In the embodiment according to FIG. 3*c* the first covers 28 are supported on the inside of an obliquely mounted plate 39 which extends upward from an opening in the outer surface of the recoil jacket, the covers in question then being supported at the upper parts of said plate. The second covers 29 are fastened in brackets 40 in the breech ring, only the bracket for one of the covers then being shown in FIG. 3*c*.

The actual supporting of the covers takes place by means of hinges 28*a* and 29*a*. In its sealing position, the first cover can coact with a mechanical stop 41 which fixes the sealing position of the cover. In FIG. 3*c* the turned down or sealing position of the cover is shown with dash lines designated 28' for one of the first covers, and it will then be noted that the blocking member coacts with the outside of the cover at its support 28*a*.

Figure 6:
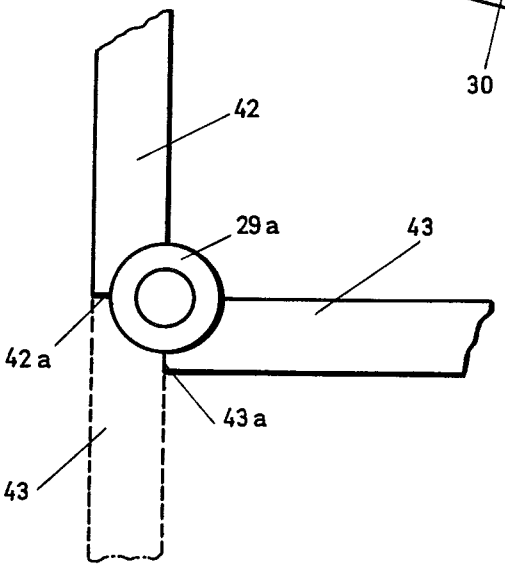
FIG. 6 shows a side view of the principle of a hinge which can be used for a cover.

The respective second cover is made with a special hinge 29*a*, the principle of which will be noted from FIG. 6. One of the parts of the hinge is designated 42 in said figure, while the other part has the designation 43. In the turned-up position of the cover, the parts of the hinge are at an angle in relation to each other as shown by the solid lines in FIG. 6, while in the turned-down position of the cover which is shown with dash lines and designated 43' two surfaces 42*a* and 43*a* of the hinge parts come into contact with each other for achieving a fixing of the position. In FIG. 3*c* the sealing position for one of the second covers is shown with dash lines and indicated 29'.

Covers 28 and 29, respectively, assume their sealing positions through their own weight. The cover can be opened by means of the loading pendulum, which in FIG. 3*c* is represented by its arm 9*b* and its round-carrying part 9*a*. In FIG. 3*c* also a rammer is designated 44. When the covers are entirely opened, they are in an oblique position (see FIG. 3*c*) so that the covers can fall back of their own weight when the loading pendulum returns after the round has been moved out of it by means of the rammer 44.

FIG. 5 shows an embodiment according to which the first covers 28 are supported in brackets on the inside of the recoil jacket, while the covers 29 are fastened to the breech ring 6*a* of the barrel, which corresponds to the case described above. In this figure, the covers are shown in their closed or sealing position and it will be noted that the inner covers 29 are located at a higher level than the covers 28, so that when the barrel recoils in the jacket the first-mentioned covers can slide over the last-mentioned covers. In accordance therewith, the insides of the covers also constitute a track for empty cartridge cases which are ejected from the firearm when firing via the cover 30 which is supported at its upper parts in the hinge 30*a*. Said covers are made of comparatively heavy steel plate or armour plate.

The invention is not limited to the embodiments shown above as examples, but can be subject to modifications within the scope of the accompanying claims.

We claim:

1. A protective device for a firearm of the type having a barrel supported in a recoil jacket and located in a tank provided with loading members for the firearm intended to convey rounds to the firearm from a magazine separate from the firearm via the under side of the recoil jacket, characterized in that the recoil jacket in connection with said under side has an opening and covers which can be opened and closed, with at least one first cover supported in the recoil jacket and at least one second cover supported in the breech ring of the barrel; and in that the first and second covers are located at different levels so that at the recoiling of the firearm in the recoil jacket they will slide one over the other.

2. A device according to claim 1, characterized in that said at least one first cover comprises a first pair of covers and said at least one second cover comprises a second pair of covers, the covers in the respective pairs being supported for opening in opposite directions about hinges oriented to coincide with the longitudinal direction of the recoil jacket.

3. A device according to claim 1, characterized in that said first cover is supported in brackets fastened to the inside of the recoil jacket.

4. A device according to claim 3, characterized in that the respective cover at least in the first pair of covers can coact with a mechanical stop in its sealing position.

5. A device according to claim 1, characterized in that the respective cover is supported on a hinge with a built-in stop.

6. A device according to claim 1, wherein the loading members comprise a loading pendulum arranged outside of the tank, characterized in that the respective cover is arranged so that it can be turned up through coaction with said loading pendulum and arranged so that it will be turned down by its own weight.

7. A device according to claim 3, characterized in that said first cover is supported in brackets fastened to the inside edge of a wall extending into the recoil jacket.

8. A device according to claim 7, characterized in that the respective cover at least in the first pair of covers can coact with a mechanical stop in its sealing position.

9. A device according to claim 7, characterized in that the respective cover is supported on a hinge with a built-in stop.

10. A device according to claim 7, wherein the loading members comprise a loading pendulum arranged outside of the tank, characterized in that the respective cover is arranged so that it can be turned up through coaction with said loading pendulum and arranged so that it will be turned down by its own weight.

* * * * *